United States Patent [19]

Hvide

[11] 4,286,537

[45] Sep. 1, 1981

[54] SEAGOING SEPARABLE TUG AND BARGE CONSTRUCTION

[76] Inventor: J. Erik Hvide, 1900 SE. 17th St., Ft. Lauderdale, Fla. 33316

[21] Appl. No.: 2,384

[22] Filed: Jan. 10, 1979

[51] Int. Cl.[3] ..... B63B 21/00

[52] U.S. Cl. ..... 114/248; 114/61

[58] Field of Search ..... 114/242, 248, 249, 77 R, 114/57, 61

[56] References Cited

U.S. PATENT DOCUMENTS

| | | | |
|---|---|---|---|
| 1,406,602 | 2/1922 | Baer | 114/249 |
| 3,347,201 | 10/1967 | Szabo | 114/248 |
| 3,557,742 | 1/1971 | Gainsley | 114/77 R |
| 3,698,349 | 10/1972 | Stevens | 114/248 |
| 3,735,722 | 5/1973 | Hooper et al. | 114/77 R X |
| 3,815,541 | 6/1974 | Hansen | 114/248 |
| 4,002,132 | 1/1977 | Nitzki | 114/61 |
| 4,013,032 | 3/1977 | Bludworth | 114/77 R X |

FOREIGN PATENT DOCUMENTS

| | | | |
|---|---|---|---|
| 512102 | 11/1930 | Fed. Rep. of Germany | 114/242 |
| 2019219 | 11/1971 | Fed. Rep. of Germany | 114/57 |

*Primary Examiner*—Sherman D. Basinger

*Attorney, Agent, or Firm*—James F. Jones

[57] ABSTRACT

An integrated and separable tug and barge unit of the Catamaran type is provided which constitutes a material improvement in operational efficiency and economy over the separable tug and barge assembly forming the basis of U.S. Pat. No. 3,698,349 granted on Oct. 17, 1972 to John N. Stevens. The tug and barge assembly of the present invention is characterized by providing a materially improved hull design for the twin hulls of the tug unit, both fore and aft, and material design changes with respect to the interfitting of the tug unit with the barge unit which will materially decrease the open area between the twin hulls of the tug unit when the units are in an interfitted relationship.

3 Claims, 9 Drawing Figures

SEAGOING SEPARABLE TUG AND BARGE CONSTRUCTION

A. FIELD OF INVENTION

The present invention relates to a new and improved cargo carrying vessel assembly in the form of two component parts, to wit, a propulsion section carrying the operating personnel and a second separable section which functions solely as a cargo carrying section. More particularly, the present invention constitutes an improvement over the integrated tug and barge assembly forming the basis for and disclosed and claimed in U.S. Pat. No. 3,698,349 granted on Oct. 17, 1972, to John N. Stevens.

The assembly disclosed and claimed in the Stevens U.S. Pat. No. 3,698,349 in its basic construction provided a twin hull tugboat of the catamaran type which constituted the propulsion unit and a barge or cargo unit which constituted the cargo carrying unit and which was designed to be detachably connected to the propulsion unit. The propulsion unit and the cargo carrying unit had their respective coupling ends interfitted with one another in a specific arrangement so as to provide a tight coupling with one another to insure a proper interfitting of the coupling ends. The Stevens unit further included wedging means positioned between the propulsion unit and the cargo carrying unit to insure that relative movement between the two units will be minimized. The basic assembly further included means to aid in drawing the units together and maintaining the two units in locked arrangement.

The Stevens U.S. Pat. No. 3,698,349, more particularly, in its broadest aspects provided a twin hull tugboat unit having a horizontally disposed shelf connecting the twin hulls together and adapted to receive and retain a projection extending rearwardly from the aft end of the barge or cargo unit in firm engagement therewith. The tugboat unit has a portion of the forward end of each hull shaped to conform with the curvature of a portion of the aft end of the barge unit hull so that a substantially tight mating engagement therebetween can be provided. Wedging means are positioned between the barge unit and the tugboat unit engagement to insure a tight engagement and to eliminate any relative movement between the tugboat unit and barge unit. Further, connecting and disconnecting means are provided between the forward end of the tugboat unit and the aft end of the barge or cargo unit to draw the tugboat and barge units tightly together and thus prevent the tugboat unit from moving aft relative to the barge unit during operation.

The Stevens integrated separable tub and barge unit constituted a marked advancement over other separable tug and barge units contemplated and patented prior to the Stevens assembly, a number of such previously patented systems being disclosed in the Stevens patent. Tug and barge units made under the Stevens patent have been in commercial use for several years and have been found to function extremely well and with no operational objections or disadvantages. However, continued activity in the design of the component units has been undertaken due to the ever increasing cost of the required fuel so as to increase the operational efficiency of the tug and barge assembly: The design changes forming the basis of the present invention have been directed to improvements in the hull design of the tug unit, both at the forward end and the aft end of each hull, the means for inter-fitting the tug and barge units to one another so as to materially fill the area between the twin hulls thereby minimizing the turbulency of the water flow and increasing the buoyancy of the tug and barge assembly, and other changes which in an over-all cumulative effect will result in the production of an improved tug and barge assembly over the tug and barge assembly produced in accordance with the Stevens patent. The present invention constitutes, therefore, an improvement over prior tug and barge assemblies made in accordance with the Stevens patent by providing various design changes therein which result in a marked operational improvement in so far as efficiency and economy is concerned, thus resulting in a marked savings in operational costs either by icreased speed for the assembly or a reduced fuel consumption in operation. Other operational and related advantages will be readilt apparent from the ensuing description of the present invention.

SUMMARY OF THE INVENTION

The present invention provides a separable tug and barge assembly that constitutes a marked improvement over the tug and barge assemblies made in accordance with the heretofore noted Stevens patent insofar as operational efficiency of the assembly is concerned. Moreover, the tug and barge assembly made in accordance with the present invention possesses an improved locking engagement between the tug and barge units by providing an enhanced wedging effect between the two units. The tug and barge assembly made in accordance with the present invention further will possess additional advantages such as, for example, improved water flow, reduced resistance under most conditions, improved carrying capacity, and improved buoyancy at the stern. The cumulative effect of the various design changes thus results in a tug and barge assembly that will be found to be a material improvement over prior separable tug and barge assemblies.

One factor leading to the development of the present invention is that the twin hull construction of the tug unit disclosed in the Stevens patent is such that the two hulls are in parallel relationship to one another thereby resulting in the outboard side of each hull being parallel to one another in the fore to aft direction. This construction results, during the operation of the assembly, in the flow of water rearwardly around the outboard side of each hull during the forward movement of the tug and barge assembly to be in parallel relationship. However, the water must ultimately converge, and such convergence will meet with considerable resistance due to the hull design of the Stevens assembly and will cause an unnatural separation of the flow of the water. As a result of the hull design employed in the Stevens tug and barge assembly there has been a water flow along the outboard side of each of the twin hulls of the tug unit which has resulted in an increased drag on the assembly thereby impairing the efficiency of the Stevens tug and barge assembly.

In accordance with the present invention this impairment of the efficiency of operation of a tug and barge assembly caused by poor water flow along the outboard side of the hull can be minimized or eliminated by providing a design in which the twin hulls of the tug will have their respective bows point outwardly such that there is an angle of divergence outwardly from the center line of the tug unit varying from between 3.0 degrees to 5.0 degrees, and preferably from between 3.5 degrees and 4.0 degrees. The angling outwardly of the twin hulls at their bow end to the extent stated results in a converging aft of the outboard side of each hull thereby permitting the flow of water to start converging inwardly as it traverses aft along the outboard side of the twin hulls.

It has been further found that a change in design relative to the tongue component of the barge or cargo unit disclosed in the Stevens assembly and its corresponding receptacle part with the tug unit will provide an assembly having a better flow of water between the inboard sides of the twin hulls of the tug, will provide less resistance when in operation, will provide additional total carrying capacity of the total assembly as a result of the added displacement and will increase the buoyancy of the stern of the overall assembly. As disclosed in the Stevens U.S. Pat. No. 3,698,349, the tug unit has a center body spanning the distance between the twin hulls with each inboard side of each hull adjacent the center body having a shelf portion which forms a recess portion in each hull running fore and aft beneath the center body. The barge or cargo unit has a shelf or tongue portion extending rearwardly from the aft end of the barge which fits against the under-surface of the center body and into each recess on the inboard side of each hull in tight engagement therewith. This arrangement previously present in the Stevens assembly resulted in an area that was unfilled for over half of the total area therebetween.

In accordance with the present invention, it has been found that an improved coupling and locking arrangement to substantially fill the area between the hulls, changes in the hull design, both fore and aft, and other improvements forming the basis of the present invention results in a seperable tug and barge assembly having materially increased operational efficiency and enhanced operational advantages when in use. In accordance with the present invention, it has been found that an enhanced coupling of the tug and barge units to one another as well as the increased operational advantages may be achieved by providing a tongue portion on the barge unit which more fully fills the area between the twin hulls. Correspondingly, the shelf area present on the inboard side of each hull of the tug unit must be increased to accomodate the greatly enlarged tongue portion of the barge. This construction will result in the filling of a greater area between the twin hulls with the tongue portion. Moreover, aft of the stern of the barge unit, the shelf or tongue portion increases in depth rearwardly to further aid in the filling of the area between the twin hulls.

It has been further found in accordance with the present invention that enhanced results in operational efficiency may be achieved by providing a design change with respect to the contour of the bottom rake of the barge and a change in hull design of the twin hulls of the tug unit. With respect to the bottom rake of the barge unit, it has been found that if the rake of the barge is so constructed as to be V-shaped in cross-section rather than flat, the open area between the twin hulls of the tug unit will be further filled thus enhancing the water flow on the inboard side of each hull of the tug unit. With respect to the hull design of the tug unit, it has been found that rather than employ the traditional U-shaped configuration heretofore used, material advantages will be achieved by having each of the hulls skewed outwardly at an angle of between about 15–30 degrees to the vertical with the preferred skewing being at an angle of about 21 degrees to the vertical.

Briefly, the objectives of the present invention in providing an improved separable tug and barge unit over the separable tug and barge unit forming the basis of the Stevens U.S. Pat. No. 3,698,349 is achieved by providing in a separable tug and barge assembly having a twin hull tug unit provided with a horizontally disposed shelf element connecting the twin hulls together, a barge unit having a tongue element extending rearwardly from the aft end thereof for engagement with the shelf element of the tug unit to hold one another in tight relationship, the tug unit having a portion of the forward end of each hull shaped to conform with the curvature of a portion of the aft end of the barge unit to insure a substantially tight mating engagement therebetween, wedging means between the tug and barge units to insure a tight engagement therebetween and to eliminate any relative movement therebetween, and means for connecting and disconnecting the tug and barge units to one another, the improvement comprising a tug unit having a pair of twin hulls spaced from one another, each of said hulls extending outwardly at its bow end forming an angle of divergence from the center line of the tug unit of between about 3.0 degrees to about 5.0 degrees thereby enhancing the flow of water along the outboard side of each hull in a converging direction towards the aft end thereof and improving the wedging effect between the tug and barge units and enhancing the connecting and disconnecting of the tug unit and barge unit to one another, each hull of the tug unit being skewed outboard at the stern end thereof at an angle of between 15–30 degrees to the vertical thereby providing an improved water flow and reducing the drag. A further improvement is in providing a barge unit in which the tongue element is of substantial thickness and materially fills the inboardarea between the twin hulls both vertically and longitudinally thereby improving the flow of water inboard between the twin hulls.

BRIEF DESCRIPTION OF THE DRAWINGS

The novel features which are believed to be characteristic of the invention are set forth with particularity in the appended claims. The invention itself, however, both as to its organization and mode of operation, together with further objects and advantages thereof, may best be understood by reference to the following description taken in conjunction with the accompanying drawings, in which:

DETAILED DESCRIPTION OF THE PREFERRED EMBODIMENTS

Prior Art

Referring now to FIGS. 1-4 of the drawings, which show the illustrative embodiment of a tug and barge assembly shown in the Stevens U.S. Pat. No. 3,698,349, a twin hull tug boat unit, generally designated by reference letter T, and a barge or cargo unit, generally designated by reference letter B, are shown in connected relationship ready for operation. The tug T is a catamaran tug unit which is characterized by having twin hulls laterally spaced from one another forming a slotted area within which the aft portion of the barge or cargo unit will be interfitted in a manner to be more fully described hereinafter. The barge unit illustrated is, by way of example only, an oil tanker and the oil carrying compartment shown in broken section. The tug boat unit is provided with the usual engine roosm, ship personnel accommodations, and all other conventional equipment necessary for a sea going tug. The tug boat unit T is a catamaran tug and utilizes large, slow turning propellors, and consequently is generally of a deep draft and powered by heavy duty engines capable of propelling or pushing large, heavily laden cargo carrying barges, tankers, or like units at an effective and efficient speed.

Figure 1:
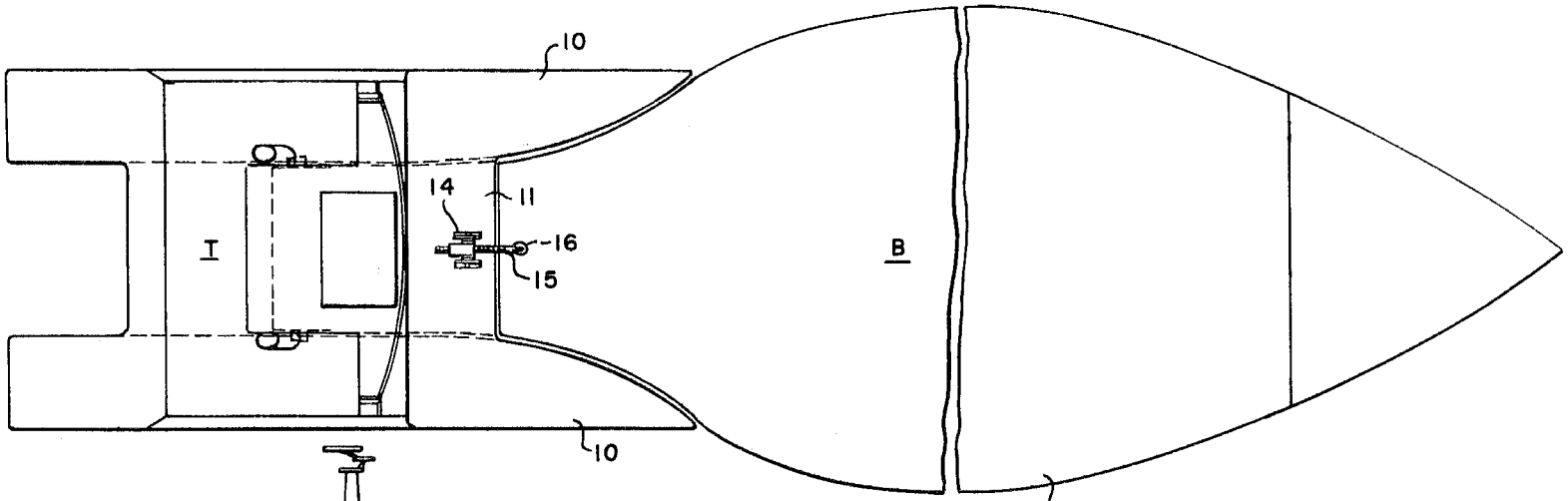
Fig. 1 PRIOR ART
FIG. 1 is a top plan view with the barge in broken section illustrating a form of a catamaran or twin hull tug and barge assembly in tight connected relationship, as disclosed in Stevens U.S. Pat. No. 3,698,349.
Figure 2:
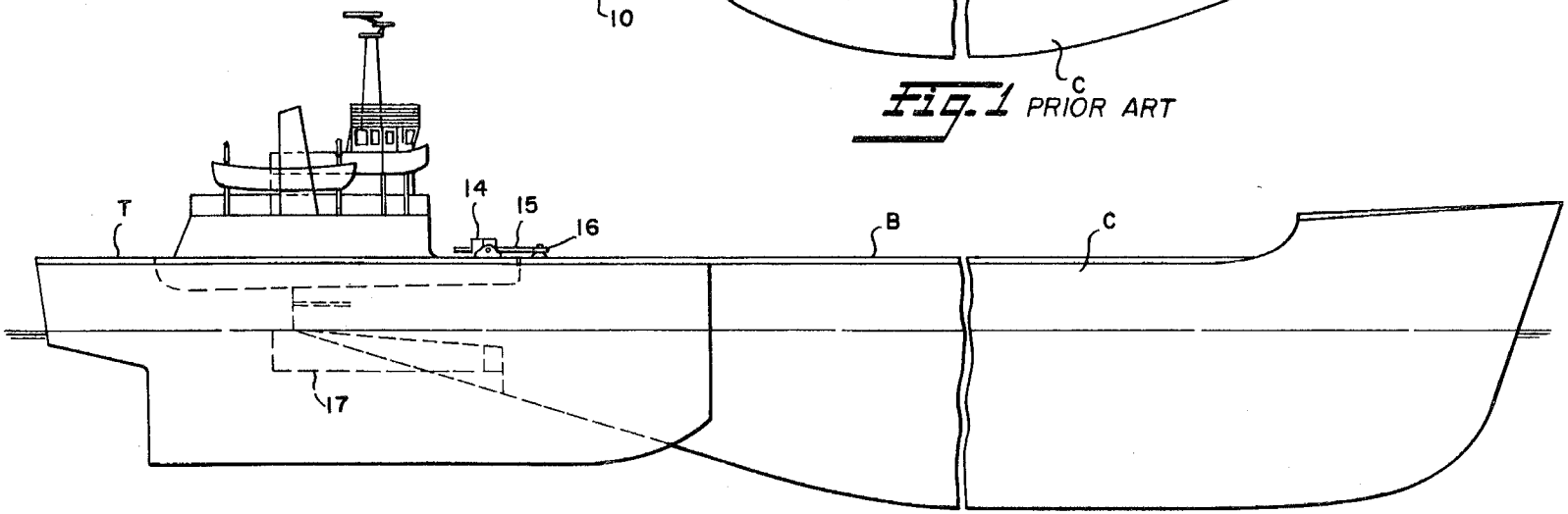
Fig. 2 PRIOR ART
FIG. 2 is a side elevation of the catamaran tug and barge assembly shown in FIG. 1 with broken lines indicating the connecting arrangement between the two units, as disclosed in Stevens U.S. Pat. No. 3,698,349.
Figure 3:
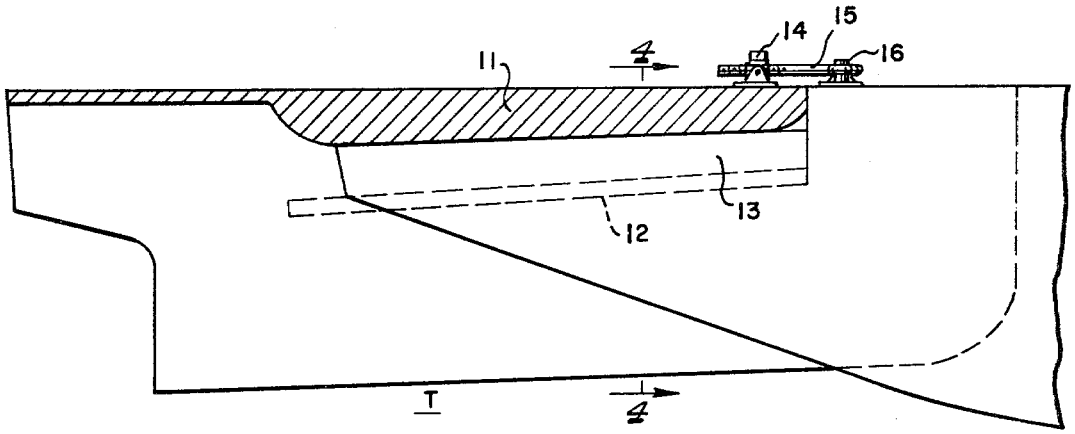
Fig. 3 PRIOR ART
FIG. 3 is an enlarged fragmentary view in side elevation and partly in section illustrating a form of nesting engagement of the projection from the aft end of a barge unit with the center portion of a tug, as disclosed in Stevens U.S. Pat. No. 3,698,349.
Figure 4:
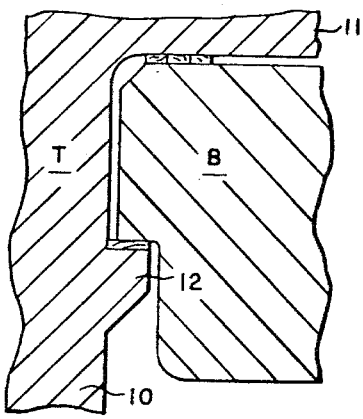
Fig. 4 PRIOR ART
FIG. 4 is a fragmentary enlarged view taken on lines 4—4 of FIG. 3 illustrating in detail the interlocking between the barge projection and the tug recess in accordance with the embodiment disclosed in Stevens U.S. Pat. No. 3,698,349.
Figure 5:
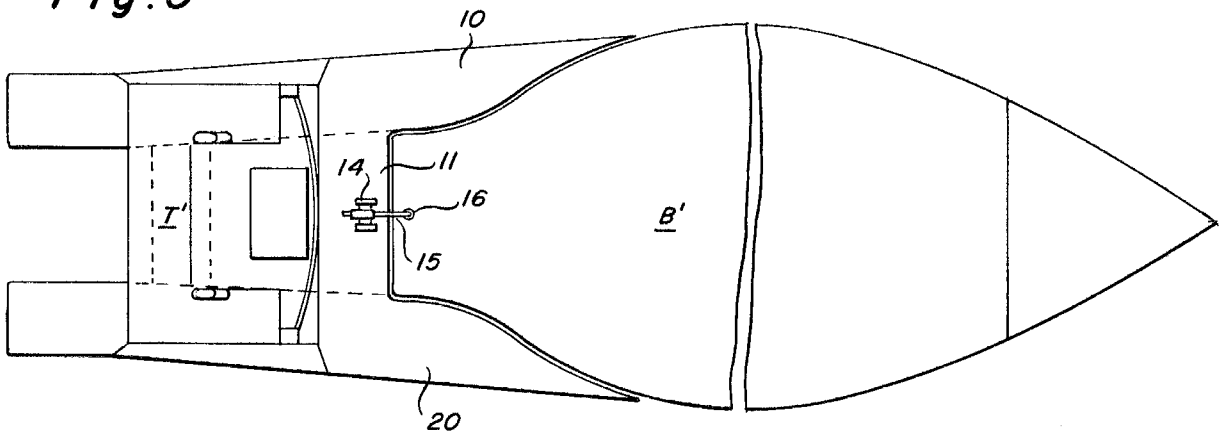
FIG. 5 is a top plan view of an embodiment of a tug and barge assembly made in accordance with the present invention with the barge in broken section illustrating one form of a catamaran or twin hull tug and barge assembly in tight connected relationship therewith and further illustrating the outward divergence of the twin hulls.
Figure 6:
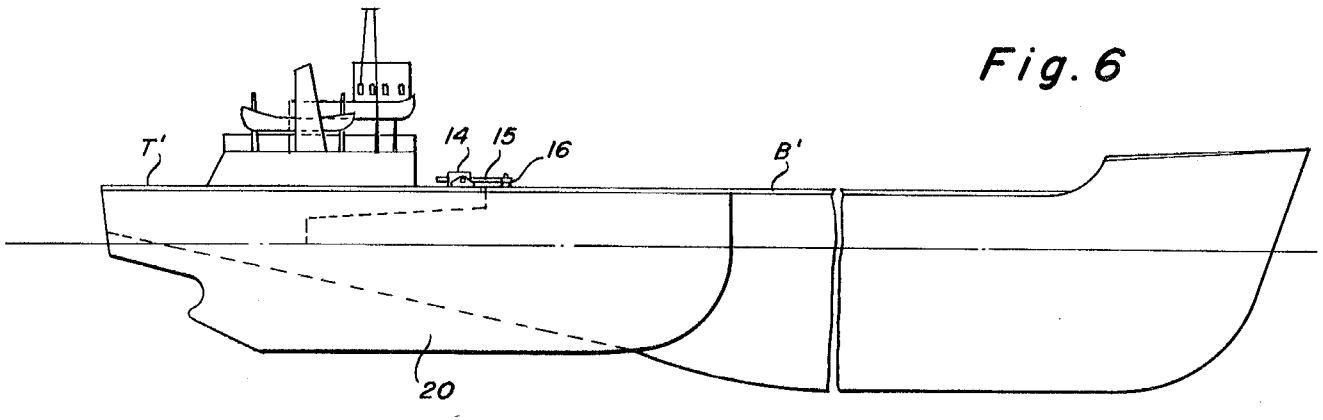
FIG. 6 is a side elevation of the catamaran tug and barge assembly shown in FIG. 5 with broken lines indicating the connecting arrangement between the two units.
Figure 7:
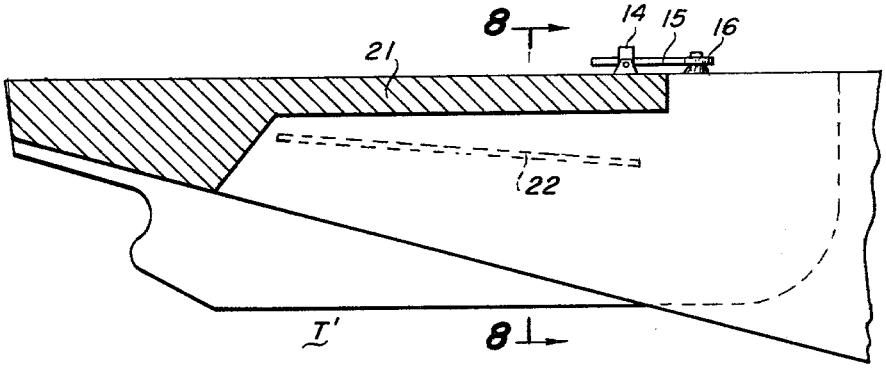
FIG. 7 is an enlarged fragmentary view in side elevation and partly in section illustrating the form of nesting engagement made in accordance with the present invention of the projection extending from the aft end of the barge with the center portion of the tug in which the area between the hulls is filled to a considerable extent.

The tug boat unit T of the Stevens patent is provided with twin hulls 10 which are asymmetrical or mirror images of one another and extend fore to aft in parallel relationship to one another. The hulls 10 are laterally spaced from one another in parallel relationship forming a slot portion between which the aft portion of the barge B, as shown in FIG. 1, will be seated. The contour of each of the hulls 10 is such that it will conform to the contour of the engaging portion of the projection extending from the aft portion of the barge B, thereby insuring that no forward movement of the tug relative to the barge will occur. It is to be emphasized that where surfaces of the tug and barge units are to be in mating relationship with one another, the respective engaging surfaces will be contoured so as to mate with one another as closely as possible.

The center body 11 of the tug unit T′ extends between the twin hulls 10 adjacent the forward end and forms a top shelf member adapted to engage the top surface of a rearwardly extending projection of the barge B in a manner to be described more fully hereinafter. The inboard side of each of the twin hulls 10 is provided with support means in the form of a longitudinally extending shelf portion 12 which is vertically spaced downwardly from the undersurface of the center body 11, forming a slot therebetween on the inboard side of each of the hulls 10. This formed slot preferably is tapered in height and has a greater vertical depth at the aft end than the forward end. This configuration will be found to be particularly desirable since it will permit ready engagement of the tug and barge units and will aid in the firm locking of the tug and barge units together thereby preventing relative vertical movement therebetween. The formed slots will receive the side edge of the rearwardly extending tongue portion of the barge B to prevent relative vertical movement between the tug and barge in a manner to be more fully described hereinafter.

The aft end of the barge B has a rearwardly extending, horizontally disposed projection or tongue member 13 of a design and configuration such that it will be nested between the twin hulls 10 of the tug T in substantially tight engagement. The top surface of the projection or tongue member 13 will tightly engage the undersurface of the center body 11, with each side edge of the tongue or projection member resting on the respective shelf portions 12 mounted on the inboard side of each of the twin hulls 10 of the tug T. The projection member 13 of the barge B, when in this locked relationship with the center body 11 and the shelf portion 12, will prevent any relative vertical movement between the tug and the barge.

As hereinbefore noted, forward movement of the tug T relative to the barge B when in assembled relationship is prevented by contact between the twin hulls 10 and the aft area and projection member 13 of the barge B. The portions of the barge B which will engage with complementary portions of the tug T will be of a contour conforming to that of the mating parts of the tug such that a flush engagement will be insured.

The top surface of the center body 11 of the tug unit T shown in the Stevens patent is provided with a centrally mounted connecting assembly which, in conjunction with a complementary connecting assembly mounted on the top surface of the projection 13 at the aft end of the barge B, serves to function as the means to prevent the tug from moving aft relative to the barge during use. Moreover, such connecting assembly will serve to draw the tug and barge together in tight relation when secured together, and will also serve to force the tug aft relative to the barge when the units are to be disconnected.

In the illustrative embodiment of the connecting assembly shown in the Stevens patent, an internally threaded rotatable nut 14 is centrally mounted on the top surface of the center body 11 of the tug and is adapted to receive one end of a screw member 15. The other end of the screw member 15 is detachably connected to a mounting member 16 firmly attached to the barge B. The rotatable nut may be motor driven by a motor (not shown) or may be mechanically rotated by a crank or other device (not shown). With this assembly, a rotation of the nut 14 will cause the screw member 15 to move aft, causing the tug T to be positively drawn to the barge. A reverse rotation of the nut 14 will positively force the tug away from the barge. Such a connecting assembly just described is illustrative in character only and represents but one of several types of connecting means readily available that could be employed in the Stevens patent to retain the tug and barge in tight fore-aft relationship thereby preventing any relative movement therebetween.

In order to further insure that no relative transverse or vertical movement will occur between the tug boat and barge unit in accordance with the Stevens patent, wedge means in the form of a movable wedge mechanism is interposed between the engaging hull portions of the tug and barge units T and B. This wedge mechanism is necessitated since a perfect fitting of the tapered sides of the tug and barge recess cannot be obtained because of manufacturing difficulties, and, as a consequence, a means of providing a fixity between the engaging surfaces of the barge and tug must be provided since relative movement of the tug and barge at sea cannot be tolerated. Such wedge mechanism may be actuated by a suitable power means, such as, for example, an electric motor thereby insuring a tight, positive wedging relationship. This wedge mechanism, when fully extended outwardly, will further prevent vertical and transverse movement of the aft end of the center body 11 of the tug. The operation of the illustrative wedge mechanism is described in detail in the Stevens patent and will not be repeated herein.

In the operation of the invention of the Stevens patent shown in FIGS. 1–4, the tug T will be driven forwardly towards the aft end of the barge B until the projection 13 of the barge B engages the undersurface of the center body 11 of the tug T and the shelf projections 12. The free end of the screw member 15 of the tug T is connected to the barge mounting member 16 and the nut 14 rotated thereon until the tug T and barge B are drawn together and locked in tight fore and aft relationship.

The wedge members 20, whether they be two or more, are then driven in an aftward direction by means of the operating shafts 21 into the respective recesses or channels 18 and 19 of the tug and barge until the wedge members 20 are in their outermost and locked positions. The tug T and barge B are now in an absolutely locked relationship so that any forward movement of the tug relative to the barge is prevented. Moreover, no vertical movement of the tug relative to the barge is possible and at the same time no lateral movement relative to the tug and barge is permitted. Thus, when in assembled state, the barge B and tug T will move as a single unitary member.

In the release or separation of the tug T from the barge B, the prime movers driving the operating shafts 21 are started and thereby resulting in the wedge members 20 being drawn forward toward the bow of the tug T causing an unwedging of the tug T and the barge B. The nut 14 is set into reverse rotation and this operation continued until the wedging action between the tug center body 11, the projection 13 of the barge B and the self portion 12 is released. The screw 15 is then disconnected from the barge mounting member 16. To complete the separation of the tug T from the barge B, the tug engines are reversed causing the tug to move aft with respect to the barge B, thus disengaging projection 13 of the barge from the center body 11 and the twin hulls 10 of the tug. This separation of the tug unit from the barge unit can be effected very rapidly by reason of this construction, which is highly desirable, particularly in the case of accidents and the like. Conversely, the tug T and barge B can be coupled in locked engagement quite easily, which is highly desirable from a standpoint of time.

The Present Invention

Reference is now to be had to FIGS. 5–9 wherein the tug and barge assembly made in accordance with the present invention is shown. Like reference letters and numerals used in the description of the Stevens tug and barge assembly will also be employed in the description of the tug and barge assembly illustrative of the present invention where identical parts are employed. Conversely, different reference letters and numerals will be employed where changes have been made.

Referring now to FIGS. 5–8, the improved tug and barge assembly of the present invention comprises a twin hull or catamaran type tug boat unit, generally designated by reference letter T′, and a barge unit, generally designated by reference letter B′, in connected relationship ready for operation. The tug unit T′ is of a catamaran type having twin hulls laterally spaced from one another thereby defining the slotted area into which the aft end of the barge B′ will be seated in the same general manner hereinbefore described with respect to the tug and barge assembly of the Stevens patent. Similarly, the tug boat unit T′ and the barge unit B′ will be designed in the same manner as the tug unit T and barge unit B of the Stevens patent to accommodate the propulsion system, operating personnel, and the like, and any desired cargo respectively to the same extent as the assembly shown in the Stevens patent.

The tug boat unit T′ is provided, as shown, with twin hulls 20 which are asymmetrical or mirror images of one another although, under some circumstances, identical hulls could be employed. The hulls 20 are laterally spaced from one another but are connected to one another by a center body 21 forming a slotted area therebetween into which the aft end of the barge unit B′ will be seated or nested to constitute the tug and barge assembly. The inboard side of each of the hulls T′ is contoured so as to conform to the contour of the mating or engaging parts of the barge B′.

The twin hulls 20′ do not extend in parallel relationship to one another fore and aft, but rather, have the bow end of each of the hulls 20 extend outwardly at its bow end forming an angle of divergence from the center line of the tug unit T′. The angle of divergence with respect to the center line may be from between about 3.0 degrees to about 5.0 degrees with the preferred angle of divergence being between about 3.5 degrees to about 4.0 degrees and the optimum angle of divergence being about 4.7 degrees. This design results, during the operation of the tug and barge assembly, in the flow of water on the outboard side of each of the hulls to be in a converging direction towards the stern end of the tug unit T′. Such a converging flow of the water will materially decrease the resistance to the movement of the assembly thereby decreasing the drag and improvement and the efficiency of operation of the tug and barge assembly. Moreover, the divergence of the twin hulls to the extent indicated will create a better wedging effect between the tug and barge units T′ and B′ and will make it easier to connect and disconnect the tug unit T' to the barge unit B'.

The center body 21 of the tug extends between the twin hulls 20 and forms a top shelf member adapted to engage the top surface of a rearwardly extending projection of the barge B' in the same general manner described hereinbefore with respect to the Stevens patent. The inboard side of each of the twin hulls 20 is provided with support means in the form of a longitudinally extending shelf or recess portion 22 which is vertically spaced downwardly from the undersurface of the center body 21, forming a longitudinally extending slot therebetween on the inboard side of each of the hulls 20. This formed slot preferably is tapered in height and has a greater vertical depth at the forward end than the aft end. This configuration, as hereinbefore noted in the discussion of the Stevens patent with respect to FIGS. 1–4, will permit ready engagement of the tug and barge to one another and will prevent relative vertical movement therebetween. The formed slots will receive the side edge of the rearwardly extending portion of the barge B to prevent relative vertical movement between the tug and barge in the same manner as fully described hereinbefore with respect to the Stevens patent assembly shown in FIGS. 1–4.

The aft end of the barge B' has a rearwardly extending, horizontally disposed projection member 23 of a design and configuration such that it will be nested between the twin hulls 20 of the tug T' in substantially tight engagement therewith. The top surface of the projection 23 will be in substantially flush engagement with the undersurface of the center body 21, with each side edge of the projection resting on the respective shelf portions 22 and within the formed slots on the inboard side of each of the twin hulls 20 of the tug T'. The projection members 23 of the Barge B', when in this locked state with the center body 21, the shelf portion 22 and the formed recess, will prevent any relative vertical movement between the tug unit T' and the barge unit B' in the same general manner described herein before with respect to FIGS. 1–4 which illustrate the Stevens assembly.

Figure 8:
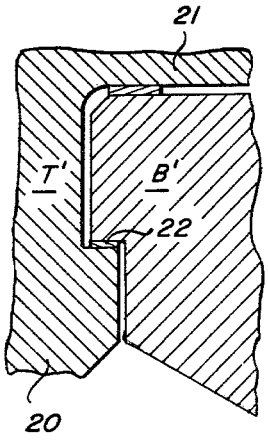
FIG. 8 is a fragmentary enlarged view taken on lines 8—8 of FIG. 7 illustrating in detail the form of interlocking between the barge projection element and the tug which results in a considerable filling in of the area between the twin hull recess.

In the embodiment shown in FIGS. 5–8, the association of the projection or tongue element 23 of the barge B' with the shelf 22 and the center body 21 of the tug unit T' is generally the same as that of the Stevens assembly, the component parts however being changed. In the present invention, the tongue or projection element 23 is of a greater vertical thickness throughout so as to more completely fill the area between the twin hulls 20. Correspondingly, the vertical gap between the underside of the centerbody 21 and the shelf 22, as shown in FIG. 8, is materially greater so as to accomodate the increased thickness of the projection member 23. The increased thickness is also carried aft by the center body 21 of the tug unit T' and will extend further down all the way to the stern of the twin hulls 20. This design will result in a filling of greater than one-half and preferably greater than three-fourths of the area between the twin hulls 20 of the tug unit T'. Such a construction results in a better flow of water between the inboard sides of the twin hulls 20 thereby improving the operational efficiency of the assembly. Moreover, this design will provide less resistance, improve the total carrying capacity of the assembly as a result of added displacement, and will give added buoyance to the stern of the assembly. Such a construction results in a better flow of water between the inboard side of the twin hulls 20 thereby improving the operational efficiency of the assembly. Moreover, this design will provide less resistance at deep loaded drafts, improve the total carrying capacity of the tug and barge assembly as a result of added displacement, and will give added buoyance to the stern of the assembly.

The top surface of the center body 21 of the tug is provided with a centrally mounted connecting assembly which, in conjunction with a complementary connecting assembly mounted on the top surface of the projection member 23 at the aft end of the barge B', serves to function as the means to prevent the tug from moving aft relative to the barge during use. Moreover, such connecting assembly will serve to draw the tug and barge units together in tight relation when secured together, and will also serve to force the tug aft relative to the barge when the units are to be disconnected.

In the illustrative embodiment of the connecting assembly shown in the embodiment of the present invention, the same connecting assembly shown in FIGS. 1–4 in describing the Stevens assembly may be used. As shown, the connecting assembly comprises an internally threaded rotatable nut 14 centrally mounted on the top surface of the center body 21 of the tug and which is adapted to receive one end of a screw member 15. The other end of the screw member 15 is detachably connected to a mounting member 16 firmly attached to the barge B'. The rotatable nut may be motor driven by a motor or may be mechanically rotated by a crank or other device. With this assembly, a rotation of the nut 14 will cause the screw member 15 to move aft, causing the tug T' to be positively drawn to the barge B'. A reverse rotation of the nut 14 will positively force the tug away from the barge. It is to be clearly understood that the connecting assembly just described is illustrative in character only and represents but one of several types of connecting means readily available that may be employed to retain the tug and barge in tight fore-aft relationship thereby preventing any relative movement therebetween.

In the embodiment shown in FIGS. 5–8, wedge means are to be used between the tug unit T' and the barge unit B' to insure that there will be no relative movement between the tug unit T' and the barge unit B'. The wedge means to be employed in the embodiment shown in FIGS. 5–8 is the same as that employed in FIGS. 1–4 illustrating the Stevens embodiment. No further description need be given here since the operation of the wedge mechanism is fully described in Stevens U.S. Pat. No. 3,698,349.

It is to be clearly understood that the wedge means disclosed in the Stevens patent for use in the present invention is illustrative in character only. For example, wedge means operating in a vertical direction between the tug and barge units may be employed. In such an operation, the wedge means will be moved in a vertical direction between the tug and barge units to achieve the desired wedging. Another form of wedging means to insure that there will be no relative movement between the tug unit and the barge unit, compressive wedge means in the form of metal faced sandwich elements may be employed at various points between the tug and barge units. With this form of wedge means, the movement of the tug and barge units into a locked relationship will cause a compressive force to be created therebetween, thus preventing relative movement between the tug and barge units.

The operation of the tug and barge assembly forming the basis of the present invention and illustrated in FIGS. 5–8 is generally the same as that for the Stevens assembly shown in FIGS. 1–4. Therefore, the description given hereinbefore with respect to the description of the assembly shown in FIGS. 1–4 illustrative of the Stevens assembly is equally applicable to the present invention and need not be repeated herein. The resulting assembly of the tug and barge units T′ and B′, however, will possess the structurally different characteristics heretofore described which will impart the desired improved operational advantages to the desired assembly.

Figure 9:
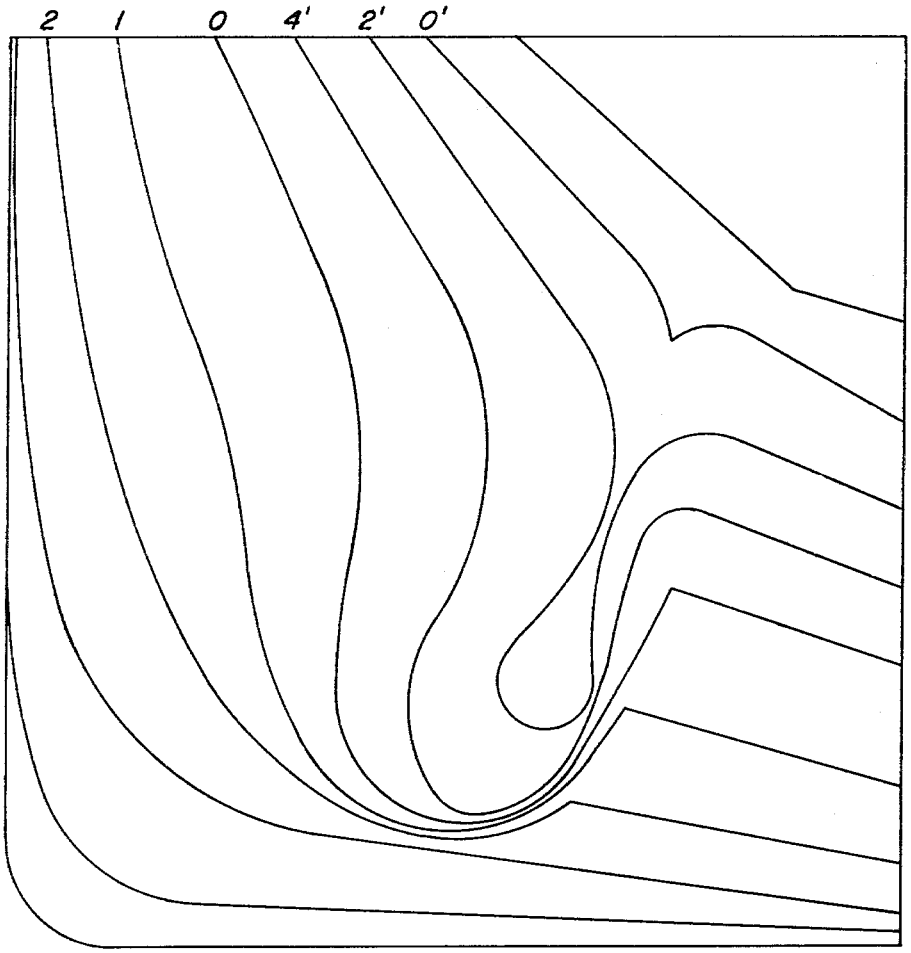
FIG. 9 is a body plan of the after body of one of the twin hulls made in accordance with the present invention and shown in association with a portion of the tug unit and illustrating the skewing outboard of the hull at the stern end at an angle of about 21 degrees to yhe vertical.

Reference is now to be had to FIG. 9, which is a body plan of one half of the afterbody of the tug unit T′ and is, in effect, for one hull of the tug unit. It is to be understood the other hull will be of the same configuration. The cross-sections of the afterbody are shown in FIG. 9 at the various equally spaced stations 3, 2, 1, 0, 4′, 2′, and 0′. This body plan illustrates clearly the contour design of each hull 20 and the outboard skewing of each hull at an angle of approximately 21 degrees to the vertical. The outward skewing of each hull rather than employing the conventional U-shaped configuration results in an improved water flow, reduces the drag on the assembly, and thereby permits a substantial improvement in the operation of the tug and barge assembly either by resulting in increased speed or a reduction in fuel useage.

While there have been described herein what are at present considered preferred embodiments of the invention, it will be obvious to those skilled in the art that modifications and changes may be made without departing from the essence of the invention. It is therefore to be understood that the exemplary embodiments are illustrative and not restrictive of the invention, the scope of which is defined in the appended claims, and that all modifications that come within the meaning and range of equivalency of the claims are intended to be included therein.

I claim:

1. In a separable tug and barge assembly having a twin hull tug unit provided with a horizontally disposed shelf element connecting the twin hulls together, a barge unit having a tongue element extending rearwardly from the aft end thereof for engagement with the shelf element of the tug unit to hold one another in tight relationship, the tug unit having a portion of the forward end of each hull shaped to conform with the curvature of a portion of the aft end of the barge unit to insure a substantially tight mating engagement therebetween, wedging means between the tug and barge units to insure a tight engagement therebetween and to eliminate any relative movement therebetween, and means for connecting and disconnecting the tug and barge units to one another, the improvement comprising a tug unit having a pair of twin diverging hulls spaced from one another at the bow end thereof such that the outboard sides are not parallel to the center line of the combined tug and barge, each of said hulls extending outwardly at its bow end forming an angle of divergence from the center line of the tug unit of between about 3.0 degrees to about 5.0 degrees thereby enhancing the flow of water along the outboard side of each hull in a converging direction towards the aft end thereof and improving the wedging effect between the tug and barge units and enhancing the connecting and disconnecting of the tug unit and barge unit to one another, each hull of the tug unit being skewed outboard at the aft end thereof at an angle to the vertical of between 15–30 degrees thereby providing an improved water flow and a reduction in the water drag and a barge shaped to conform in an integrated state with the lines of the tug.

2. In a separable tug and barge assembly in accordance with claim 1, the improvement of providing the tongue element of the barge unit and the shelf element of the tug unit of a dimensional arrangemnt so that when the tug unit and barge unit are in an inter-fitted relationship, the normal area between the twin hulls of the tug unit will be filled more than one-half the normal area.

3. In a separable tug and barge assembly in accordance with claim 1 wherein the rake of the barge unit is V-shaped in cross-section.

* * * * *